United States Patent [19]

Hatakeyama et al.

[11] Patent Number: 4,594,055

[45] Date of Patent: Jun. 10, 1986

[54] PISTON ASSEMBLY FOR A REFRIGERANT COMPRESSOR

[75] Inventors: Hideharu Hatakeyama; Hidenao Takahashi, both of Isesaki, Japan

[73] Assignee: Sanden Corporation, Gunma, Japan

[21] Appl. No.: 684,332

[22] Filed: Dec. 20, 1984

[30] Foreign Application Priority Data

Dec. 20, 1983 [JP] Japan ..... 58-197942[U]

[51] Int. Cl.[4] ..... F04B 1/18; F01B 31/10

[52] U.S. Cl. ..... 417/269; 92/159; 92/251

[58] Field of Search ..... 92/158, 159, 248, 249, 92/251, 253; 417/269, 222

[56] References Cited

U.S. PATENT DOCUMENTS

| | | | |
|---|---|---|---|
| Re. 27,844 | 12/1973 | Olson, Jr. | 417/269 |
| 2,615,769 | 10/1952 | Barnes | 92/253 |
| 2,801,140 | 7/1957 | Kretzer | 92/251 |
| 3,885,460 | 5/1975 | Park | 417/269 |
| 3,982,471 | 9/1976 | Finger | 92/158 |
| 4,011,029 | 3/1977 | Shimizo | 417/269 |
| 4,351,227 | 9/1982 | Copp | 417/269 |
| 4,416,589 | 11/1983 | Perry | 417/550 |
| 4,480,964 | 11/1984 | Skinner | 417/222 |

FOREIGN PATENT DOCUMENTS

| | | | |
|---|---|---|---|
| 895667 | 5/1962 | United Kingdom | 92/249 |

*Primary Examiner*—William L. Freeh

*Attorney, Agent, or Firm*—Banner, Birch, McKie & Beckett

[57] ABSTRACT

A piston assembly for a reciprocating piston type compressor includes a piston slidably disposed within aluminum alloy cylinders. The pistons have two annular grooves provided toward opposite ends on their outer peripheral surfaces. A conical shaped piston ring formed of resin and having an outer diameter larger than the outer diameter of the piston is disposed in each groove. The conical shaped piston ring creates a gap between the piston and cylinder to prevent direct contact between the piston and cylinder to thereby avoid abnormal wearing while effectively maintaining the flow of lubricating oil from the cylindrical chamber to the crank chamber.

6 Claims, 9 Drawing Figures

PISTON ASSEMBLY FOR A REFRIGERANT COMPRESSOR

BACKGROUND OF THE INVENTION

This invention relates generally to a refrigerant compressor, and more particularly, to an improvement in a piston assembly for a refrigerant compressor for use in a vehicle air conditioning system.

Generally, in piston type refrigerant compressors, the piston is slidably mounted inside a cylindrical liner formed by a casting process which takes into account the resistance to wear and durability of the compressor. This cylindrical liner must be placed inside a compressor housing formed of an aluminum alloy during a die casting process. Since the cylindrical liner must be inserted within the compressor housing during the die casting process, the weight of the cylindrical liner cannot be reduced below a predetermined amount which thereby increases the cost of manufacturing the compressor housing and the cylindrical liner.

One attempt to resolve the above disadvantages has been to form the cylindrical liner of an aluminum alloy rather than by casting. In this construction of the compressor, the weight and cost of the compressor housing is reduced but other disadvantages occur. For instance, the piston ring of the compressor, which is generally disposed on the outer peripheral surface of the piston to improve the sealing between the cylinder chamber and the crank chamber in the compressor housing, is generally formed of a high hardness material. Since this high hardness piston ring contacts the cylindrical liner, heavy wearing of the cylindrical liner occurs. Thus, it is not desirable to use a high hardness piston ring with an aluminum alloy cylindrical liner. Instead, a resinous piston ring is used with an aluminum alloy cylindrical liner to reduce wearing of the cylindrical liner.

Nevertheless, when an aluminum alloy cylindrical liner is used with a resinous piston ring in a wobble plate type compressor of the type described in U.S. Pat. No. Re. 27,844 and shown in FIG. 1, during the reciprocating motion of piston 27', the lower edge of one side of the piston often contacts the inner surface of cylindrical liner 12'. This contact occurs because each connecting rod 28' in the above wobble plate type compressor is connected to a wobble plate at some angle to the center line of the cylindrical liner. Accordingly, during the reciprocating motion of the piston within the cylindrical liner, the lower end portion on one side of the piston usually is pushed toward the inner surface of the cylindrical liner, contacts the cylindrical liner and causes abnormal wearing of the cylindrical liner.

SUMMARY OF THE INVENTION

It is a primary object of the present invention to provide an improved piston assembly for a refrigerant compressor wherein an aluminum cylindrical liner can be used without abnormal wearing of the aluminum cylindrical liner due to movement of the piston.

Another object of this invention is to provide a piston assembly for a refrigerant compressor wherein the sealing between the piston and cylinder is improved with a simple construction.

It is still another object of this invention to provide a piston assembly for a refrigerant compressor wherein the amount of lubricating oil returning from the cylinder chamber to the crank chamber is substantially increased.

It is a further object of this invention to accomplish all the above objects with a simple construction.

A refrigerant compressor according to this invention includes a compressor housing having a cylindrical liner formed integral with the compressor housing and a crank chamber adjacent the cylindrical liner. A piston is slidably fitted within each of the cylinders formed in the cylindrical liner and is reciprocated by a driving mechanism which includes a drive shaft. A cylinder head, which includes a suction chamber and a discharge chamber, is disposed on one end portion of the cylindrical liner to cover a valve plate assembly. Each piston is provided with two annular grooves at the outer peripheral surface of the piston and a conical shaped piston ring, which has an outer diameter larger than the outer diameter of the piston at normal temperature, is disposed within each annular groove.

Further objects, features and other aspects of this invention will be understood from the following detailed description of the preferred embodiments of this invention with reference to the annexed drawings.

BRIEF DESCRIPTION OF THE DRAWINGS

FIG. 4(*b*) is an enlarged view of circle A in FIG. 4(*a*).

FIGS. 6, 6*a*, 6*b* and 7 are views similar to FIGS. 4 and 5 showing another embodiment of this invention.

DETAILED DESCRIPTION OF THE PREFERRED EMBODIMENTS

Figure 2:
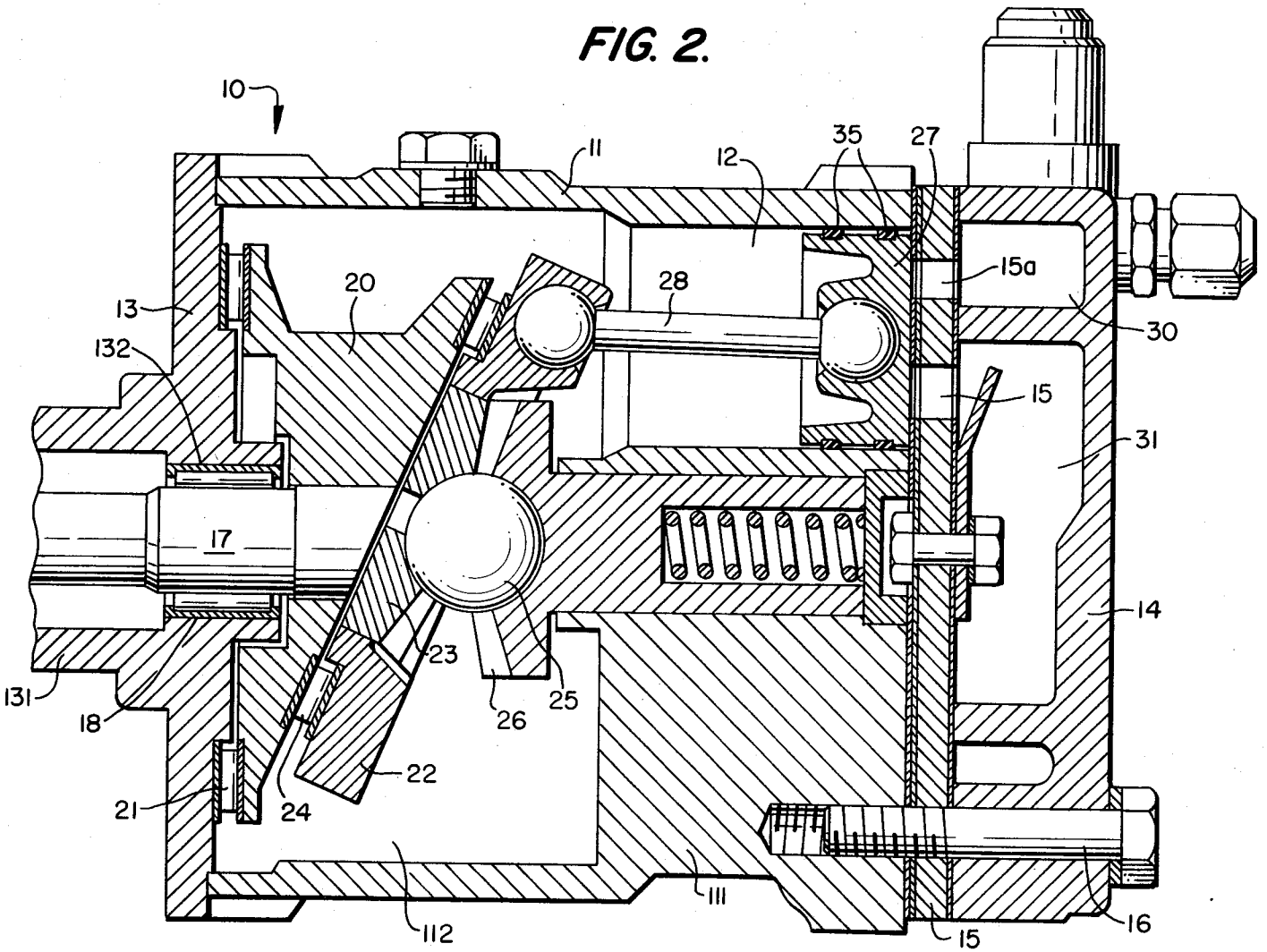
FIG. 2 is a vertical cross-sectional view of a wobble plate type compressor according to one embodiment of this invention.

Referring to FIG. 2, a wobble plate type refrigerant compressor according to the invention is shown. The compressor, generally designated 10, comprises cylindrical housing 11 which is formed of an aluminum alloy. Cylindrical housing 11 includes cylinder block 111 in one end portion thereof, a hollow portion, such as crank chamber 112 at the other end portion, front end plate 13 and cylinder head 14. Front end plate 13 is mounted on the left end portion of crank chamber 112 by a plurality of screws (not shown). Cylinder head 14 together with valve plate assembly 15 are mounted on cylinder block 111 on the other end of housing 11 by a plurality of screws 16 (one of which is shown in FIG. 2) to form a closed housing assembly for the compressor. Opening 132 is formed in front end plate 13 and drive shaft 17 is rotatably supported by a bearing, such as radial needle bearing 18, which is disposed in opening 132. Front end plate 13 includes annular sleeve portion 131 which projects from the front surface thereof and surrounds drive shaft 17 to define a shaft seal cavity in which a shaft seal assembly (not shown) is disposed.

At its inner end, drive shaft 17 is attached by any suitable means to a swash plate or cam rotor 20 so that cam rotor 20 is rotated along with drive shaft 17. Thrust needle bearing 21 is disposed between the inner surface of front end plate 13 and the adjacent axial end surface of cam rotor 20. The outer end of drive shaft 17, which extends outwardly from the housing, is adapted to be driven by the engine of the vehicle in which the compressor is contained through a conventional clutch and pulley assembly.

The slanted surface of cam rotor 20 is placed in close proximity to the surface of wobble plate 22, which is mounted on oscillating bevel gear 23 and engaged by thrust needle bearing 24 between swash plate 20 and wobble plate 22. Wobble plate 22 nutates or oscillates about ball bearing 25 seated within a fixed bevel gear 26. The engagement of bevel gears 23 and 26 prevents rotation of wobble plate 22.

Cylinder block 111 is formed integral with cylindrical housing 11, i.e., it also is formed of an aluminum alloy, and cylinders 12 are provided in which pistons 27 slidably fit. A typical cylinder arrangement would include five cylinders, but a smaller or larger number of cylinders may be provided. All pistons 27 are connected to wobble plate 22 by connecting rods 28.

Cylinder head 14 of the compressor is shaped to define suction chamber 30 and discharge chamber 31. Valve plate assembly 15, which is secured to the outer end portion of cylinder block 111 by screws 16 together with cylinder head 14, is provided with a plurality of valved suction ports **15*a* connected between suction chamber 30 and the respective cylinders 12, and a plurality of valved discharge ports 15*b* connected between discharge chamber 31 and the respective cylinders 12. Suitable reed valves for suction ports 15*a* and discharge ports 15*b*** are described in U.S. Pat. No. 4,011,029 to Shimizu.

In operation, drive shaft 17 is rotated by the engine of the vehicle to rotate cam rotor 20. The rotation of cam rotor 20 causes non-rotatable, wobbling motion of wobble plate 22 about ball bearing 25. As wobble plate 22 wobbles, pistons 27 reciprocate out of phase in their respective cylinders 12. Upon reciprocation of the pistons, refrigerant gas is taken into, compressed and discharged from the cylinders.

Figure 1:
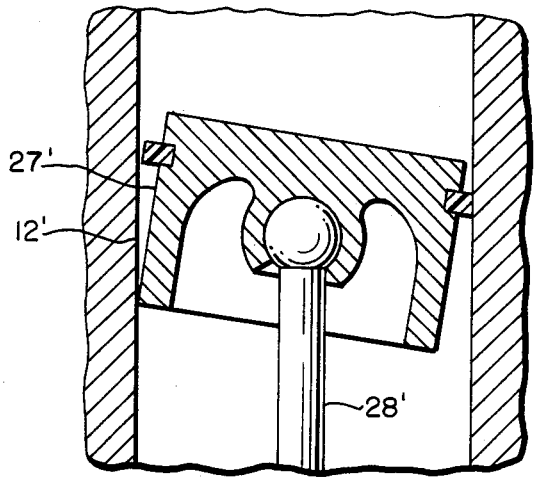
FIG. 1. PRIOR ART
FIG. 1 is a partial sectional view of a wobble plate type compressor illustrating the movement of the piston within the cylinder.
Figure 3:
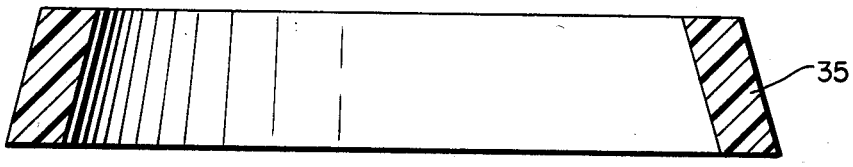
FIG. 3 is a cross-sectional view of a piston ring used in the compressor of FIG. 2.
Figure 4A:
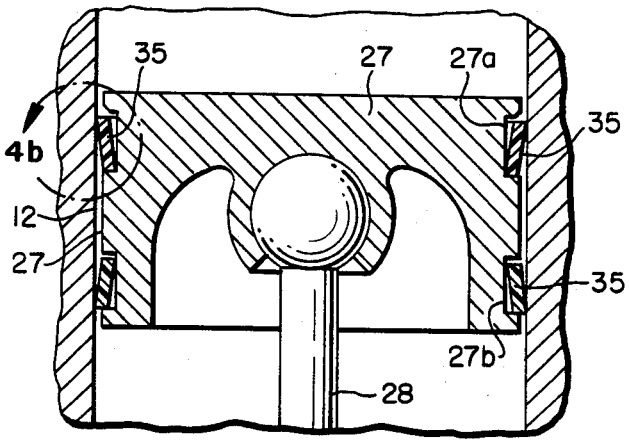
FIG. 4(*a*) is a partially enlarged view of a piston assembly used in FIG. 2.
Figure 4B:
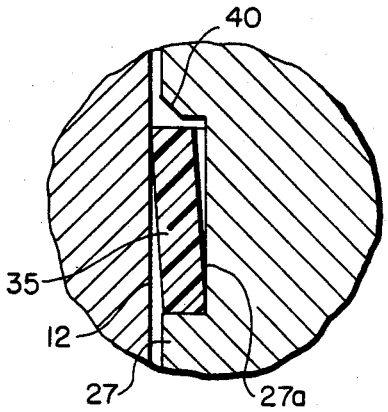

Referring to FIGS. 2 and 4, piston 27 is provided with two annular grooves **27*a* and 27*b* at its outer peripheral surface near the top and bottom portions thereof. Conical shaped piston ring 35, which is formed of resin and has a configuration as shown in further detail in FIG. 3, fits into each groove 27*a*, 27*b* to seal the outer peripheral surface of piston 27 and an inner surface of cylinder 12. This piston ring 35 also reduces the slant of piston 27. Under normal temperature conditions, the outer diameter of piston ring 35 is larger than the outer diameter of piston 27**.

In the above construction of the piston assembly, in outer groove **27*a*, the larger open side of conical shaped piston ring 35 faces the outer or top dead point side of cylinder 12. In inner groove 27*b* of piston 27, the larger open side of the other conical shaped piston ring 35 faces the inner or bottom dead point side of cylinder 12. As a result, midway pressure chamber B is defined between the piston rings 35 and, during the compression stroke of the compressor, pressure Pb in midway pressure chamber B is given by $Pa > Pb > Pc$, where Pa is the pressure in the cylinder chamber and Pb is the pressure in crank chamber 112. This arrangement of conical shaped piston rings 35 enhances the sealing between the outer peripheral surface of piston 27 and the inner surface of cylinder 12**.

Figure 5:
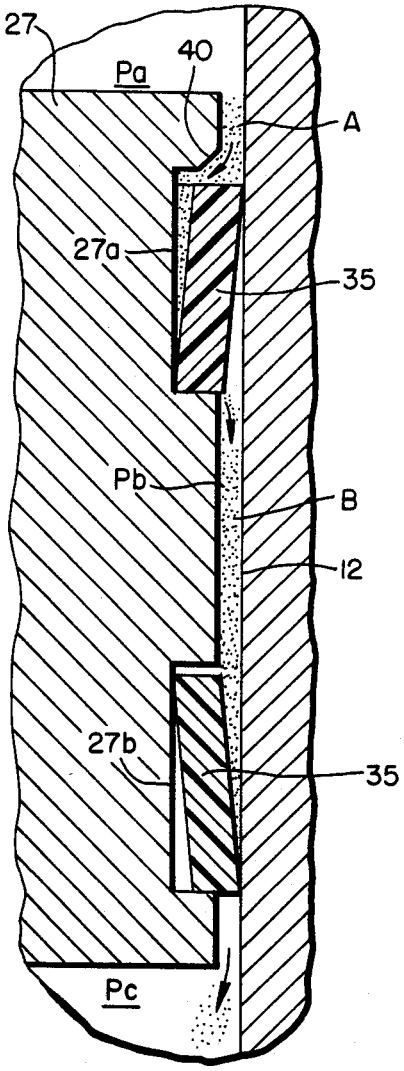
FIG. 5 is an enlarged view of FIG. 3 illustrating the return flow of lubricating oil.

Referring now to FIG. 5, the flow of lubricating oil from the cylinder chamber to crank chamber 112 will be described. The lubricating oil, which is separated from the refrigerant gas by the piston, is taken into cylinder chamber 12 and accumulates in upper space A adjacent the piston. Upper space A is defined by piston 27, cylinder 12 and one of the piston rings 35. In the embodiment shown in FIGS. 4 and 5, upper groove **27*a* includes beveled portion 40 at the upper edge thereof to improve the oil accumulation efficiency and the responsiveness of the piston ring to changes in pressure. During the compression stroke, the accumulated oil is discharged through a gap adjacent piston 27 and groove 27*a* to space B defined by piston 27, cylinder 12 and the two piston rings 35. Also, additional lubricating oil is accumulated in space A. The lubricating oil in space B leaks to crank chamber 112 due to the change of gas pressure along the gap between piston ring 35 and cylinder 12. Then, during the suction stroke, the lubricating oil which adheres to the inner surface of cylinder 12 is scraped off by the lower edge portion of piston ring 35 disposed in lower groove 27*b* of piston 27. As a result, lubricating oil which is taken into the cylinder chamber together with the refrigerant gas is easily returned from the cylinder chamber to crank chamber 112, even though increased sealing occurs between the piston and cylinder due to the use of two piston rings 35**.

Figure 6A:
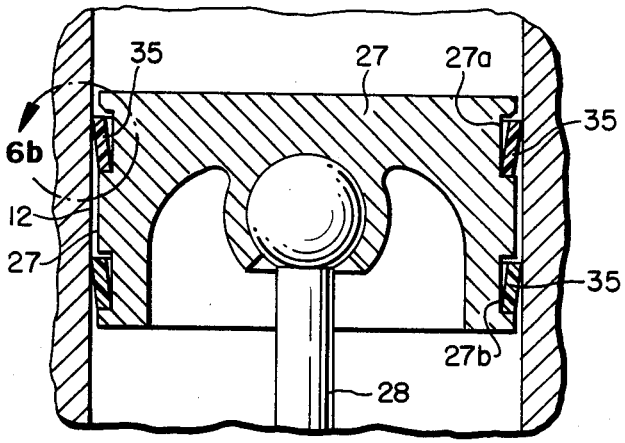
Figure 6B:
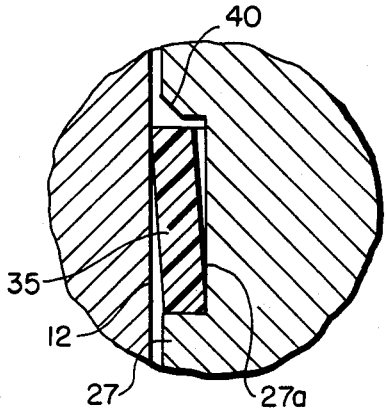
Figure 7:
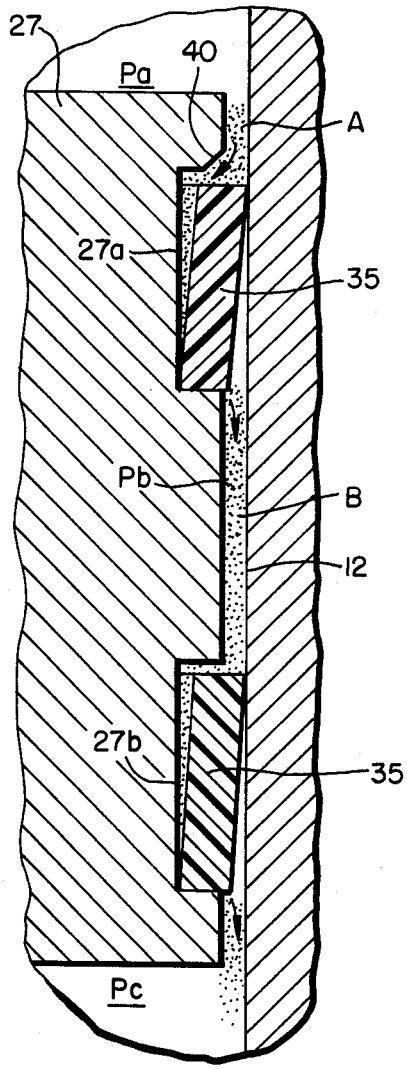

Referring to FIGS. 6 and 7, the position of piston ring 35 disposed in lower groove **27*b* of piston 27 is reversed, i.e., the larger open side of conical shaped piston ring 35 faces the outer or top dead point side of cylinder 12. During the compression stroke, the lubricating oil in space B leaks to crank chamber 112 through a gap between piston ring 35 and lower groove 27*b* of the piston. Then, during the suction stroke, the lubricating oil which adheres to the inner surface of cylinder 12 is scraped off by the upper edge portion of piston ring 35 disposed in lower groove 27*b* of piston 27**.

As mentioned above, piston 27 has two grooves on its outer peripheral surface and a resinous conical shaped piston ring is disposed within each groove to prevent direct contact between the piston and cylinder. Thus, even if the cylindrical liner is formed of an aluminum alloy, abnormal wearing of the cylindrical liner is prevented. By providing a construction of a piston assembly in which the cylindrical liner can be formed of an aluminum alloy without excessive wear, reduction in the total weight of the compressor can be achieved and the cost for manufacturing the compressor housing can be reduced. Also, as described in detail above, sealing between the cylinder and piston is enhanced while lubricating oil is effectively returned from the cylindrical chamber to the crank chamber.

Although illustrative embodiments of the invention have been described in detail with reference to the accompanying drawings, it is to be understood that the invention is not limited to those precise embodiments. Various changes and modifications may be effective therein by one skilled in the art without departing from the scope or spirit of the invention.

We claim:

1. In a refrigerant compressor including a compressor housing having a plurality of cylinders and a crank chamber adjacent said cylinders, a reciprocable piston slidably fitted within each of said cylinders, a driving mechanism coupled to said pistons to move said pistons in a reciprocating motion, a valve plate with valve openings covering one end of said cylinders and a cylinder head covering said valve plate and including a suction chamber and a discharge chamber aligned with said valve openings, the improvement comprising two annular grooves provided toward opposite ends on the outer peripheral surface of each of said pistons and a conical shaped piston ring disposed within each of said annular grooves having an outer diameter larger than the outer diameter of said piston at normal temperatures, one of said piston rings on each piston being disposed on the outer portion of said piston with the base of said conical shaped piston ring facing the outer side of said piston toward said valve plate.

2. The refrigerant compressor of claim 1 wherein the other of said piston rings on each piston is disposed on the inner portion of said piston with the base of said conical shaped piston ring facing the outer side of said piston toward said valve plate.

3. The refrigerant compressor of claim 1 wherein the other of said piston rings on each piston is disposed on the inner portion of said piston with the base of said conical shaped piston ring facing the inner side of said piston toward said crank chamber.

4. The refrigerant compressor of claim 1 wherein said annular groove disposed on the outer portion of said piston toward said valve plate has a beveled lip portion facing said cylinder to enable said annular groove to accumulate lubricating oil.

5. The refrigerant compressor of claim 1 wherein the liner of said cylinders is formed of an aluminum alloy.

6. The refrigerant compressor of claim 1 wherein said conical shaped piston rings are formed of resin.

* * * * *